US008559660B2

(12) United States Patent
Chiang et al.

(10) Patent No.: US 8,559,660 B2
(45) Date of Patent: Oct. 15, 2013

(54) ELECTROSTATIC ELECTROACOUSTIC TRANSDUCERS

(75) Inventors: Dar-Ming Chiang, Hsinchu (TW); Yan-Ren Chen, Daya Township (TW); Long-Cheng Cheng, Hsinchu (TW); I-Chen Lee, Jhubei (TW)

(73) Assignee: Industrial Technology Research Institute, Hsinchu (TW)

( * ) Notice: Subject to any disclaimer, the term of this patent is extended or adjusted under 35 U.S.C. 154(b) by 1368 days.

(21) Appl. No.: 11/776,555

(22) Filed: Jul. 12, 2007

(65) Prior Publication Data

US 2009/0016551 A1 Jan. 15, 2009

(51) Int. Cl.
*H04R 25/00* (2006.01)

(52) U.S. Cl.
USPC ..... 381/191; 310/311; 310/322; 310/325

(58) Field of Classification Search
USPC ..... 381/191; 310/311, 322, 325
See application file for complete search history.

(56) References Cited

U.S. PATENT DOCUMENTS

| | | | | | |
|---|---|---|---|---|---|
| 3,646,280 | A | * | 2/1972 | Tamura et al. | 381/191 |
| 3,711,941 | A | * | 1/1973 | Sessler et al. | 29/592.1 |
| 3,778,561 | A | * | 12/1973 | Reedyk | 381/113 |
| 3,833,770 | A | * | 9/1974 | Atoji et al. | 381/116 |
| 3,892,927 | A | | 7/1975 | Lindenberg | |
| 3,894,199 | A | | 7/1975 | Tamura et al. | |
| 3,896,274 | A | | 7/1975 | Fraim et al. | |
| 3,935,397 | A | | 1/1976 | West | |
| 3,942,029 | A | * | 3/1976 | Kawakami et al. | 307/400 |
| 4,016,375 | A | * | 4/1977 | Van Turnhout | 381/191 |
| 4,042,438 | A | * | 8/1977 | Kawakami et al. | 29/886 |
| 4,891,843 | A | * | 1/1990 | Paulus et al. | 381/191 |
| 6,658,938 | B2 | * | 12/2003 | McIntosh | 73/514.32 |
| 7,769,193 | B2 | * | 8/2010 | Matsuzawa | 381/191 |
| 7,907,740 | B2 | * | 3/2011 | Matsuzawa | 381/111 |

FOREIGN PATENT DOCUMENTS

| | | |
|---|---|---|
| CN | 1909747 A | 2/2007 |
| TW | 234232 | 11/1994 |
| TW | 200623931 | 7/2006 |
| TW | 200726300 | 7/2007 |

OTHER PUBLICATIONS

Schwodiauer, R.; Neugschwandtner, G.; Bauer-Gogonea, S.; Bauer, S.; Heitz, J.; Bauerle, D.; , "Dielectric and electret properties of novel Teflon PTFE and PTFE-like polymers," ISE 10. Proceedings. 10th International Symposium on Electrets, pp. 313-316, 1999.*

* cited by examiner

*Primary Examiner* — Duc Nguyen
*Assistant Examiner* — Taunya McCarty

(57) ABSTRACT

An electrostatic electroacoustic device comprising a first electrode configured to receive an audio signal, a second electrode configured to receive the audio signal, a first electret between the first electrode and the second electrode, the first electret including at least one dielectric layer containing electrostatic charges, a second electret between the first electrode and the second electrode, the second electret including at least one dielectric layer containing electrostatic charges, and a conductive layer sandwiched between the first electret and the second electret, the conductive layer, the first electret and the second electret being capable of vibratory motion relative to the first electrode and the second electrode based on the audio signal.

47 Claims, 8 Drawing Sheets

ELECTROSTATIC ELECTROACOUSTIC TRANSDUCERS

BACKGROUND OF THE INVENTION

This application generally relates to an acoustic device and, more particularly, to an electrostatic electroacoustic transducer.

With the increasing interest in compact, light-weight and low-profile electronics, many products, such as computer, communication and consumer electronic products, may be manufactured with miniature feature sizes. Down-sized electronic products or components may provide flexibility in various applications. For example, electroacoustic transducers, which may be divided into dynamic-type and electrostatic-type transducers, if properly reduced in dimensions, may facilitate their use in a relatively large device such as a loudspeaker or in a relatively small device such as a microspeaker or earphone. Conventional electroacoustic transducers, however, may have a relatively large size with respect to their acoustic performance. Generally, a dynamic transducer that may serve as a micro speaker in a cell phone may have a thickness of approximately 3 millimeters (mm) or above and a diameter of approximately 12 mm, with a sound pressure level of approximately 80 dB measured at a distance of 10 centimeters (cm) (hereinafter denoted as 80 dB/10 cm). Furthermore, a dynamic loudspeaker may have a thickness of approximately 5 cm or above and a diameter of approximately 12.5 cm with a required sound pressure level of 85 dB/1 meter (m). Moreover, an electrostatic transducer, to satisfy the required sound pressure level of 85 dB/1 m, may be as large as two A4-size papers with a thickness of at least approximately 2 cm.

Some conventional electrostatic transducers may include an electrically conductive film between two rigid electrode plates. In operation, a direct-current (DC) bias up to hundreds of volts or above may be applied to the electrically conductive film. Such conventional electrostatic transducers may often require a power amplifier, which may be costly and bulky.

BRIEF SUMMARY OF THE INVENTION

Examples of the present invention may provide an electrostatic electroacoustic device comprising a first electrode configured to receive an audio signal, a second electrode configured to receive the audio signal, a first electret between the first electrode and the second electrode, the first electret including at least one dielectric layer containing electrostatic charges, a second electret between the first electrode and the second electrode, the second electret including at least one dielectric layer containing electrostatic charges, and a conductive layer sandwiched between the first electret and the second electret, the conductive layer, the first electret and the second electret being capable of vibratory motion relative to the first electrode and the second electrode based on the audio signal.

In one aspect, the electrostatic electroacoustic device may be optically transparent. In another aspect, the electrostatic electroacoustic device may be flexible. In still another aspect, the electrostatic electroacoustic device may be optically transparent and flexible.

Some examples of the present invention may also provide an electrostatic electroacoustic device comprising a first electrode, a second electrode, an electret assembly between the first electrode and the second electrode, the electret assembly including a first electret, a second electret and a conductive layer sandwiched between the first electret and the second electret, a first spacer between the electret assembly and the first electrode, and a second spacer between the electret assembly and the second electrode, wherein the electret assembly being capable of vibratory motion relative to the first electrode and the second electrode based on an audio signal applied to the first electrode and the second electrode.

Examples of the present invention may further provide an electrostatic electroacoustic device comprising a first acoustic unit configured to serve as a first sound channel for a first frequency part of an audio signal, and a second acoustic unit configured to serve as a second sound channel for a second frequency part of the audio signal, wherein each of the first acoustic unit and the second acoustic unit comprises a first electrode, a second electrode, a first electret between the first electrode and the second electrode, the first electret including at least one dielectric layer containing electrostatic charges, a second electret between the first electrode and the second electrode, the second electret including at least one dielectric layer containing electrostatic charges, and a conductive layer sandwiched between the first electret and the second electret, the conductive layer, the first electret and the second electret being capable of vibratory motion relative to the first electrode and the second electrode based on the audio signal.

Although the present invention has been described with reference to specific example embodiments, it is evident that various modifications and changes may be made to these embodiments without departing from the broader spirit and scope of the invention. Accordingly, the specification and drawings are to be regarded in an illustrative rather than a restrictive sense.

BRIEF DESCRIPTION OF THE SEVERAL VIEWS OF THE DRAWINGS

The foregoing summary, as well as the following detailed description of the invention, will be better understood when read in conjunction with the appended, exemplary drawings. It should be understood, however, that the invention is not limited to the precise arrangements and instrumentalities shown.

In the drawings.

DETAILED DESCRIPTION OF THE INVENTION

Reference will now be made in detail to the present examples of the invention illustrated in the accompanying drawings. Wherever possible, the same reference numbers will be used throughout the drawings to refer to the same or like portions.

Figure 1A:
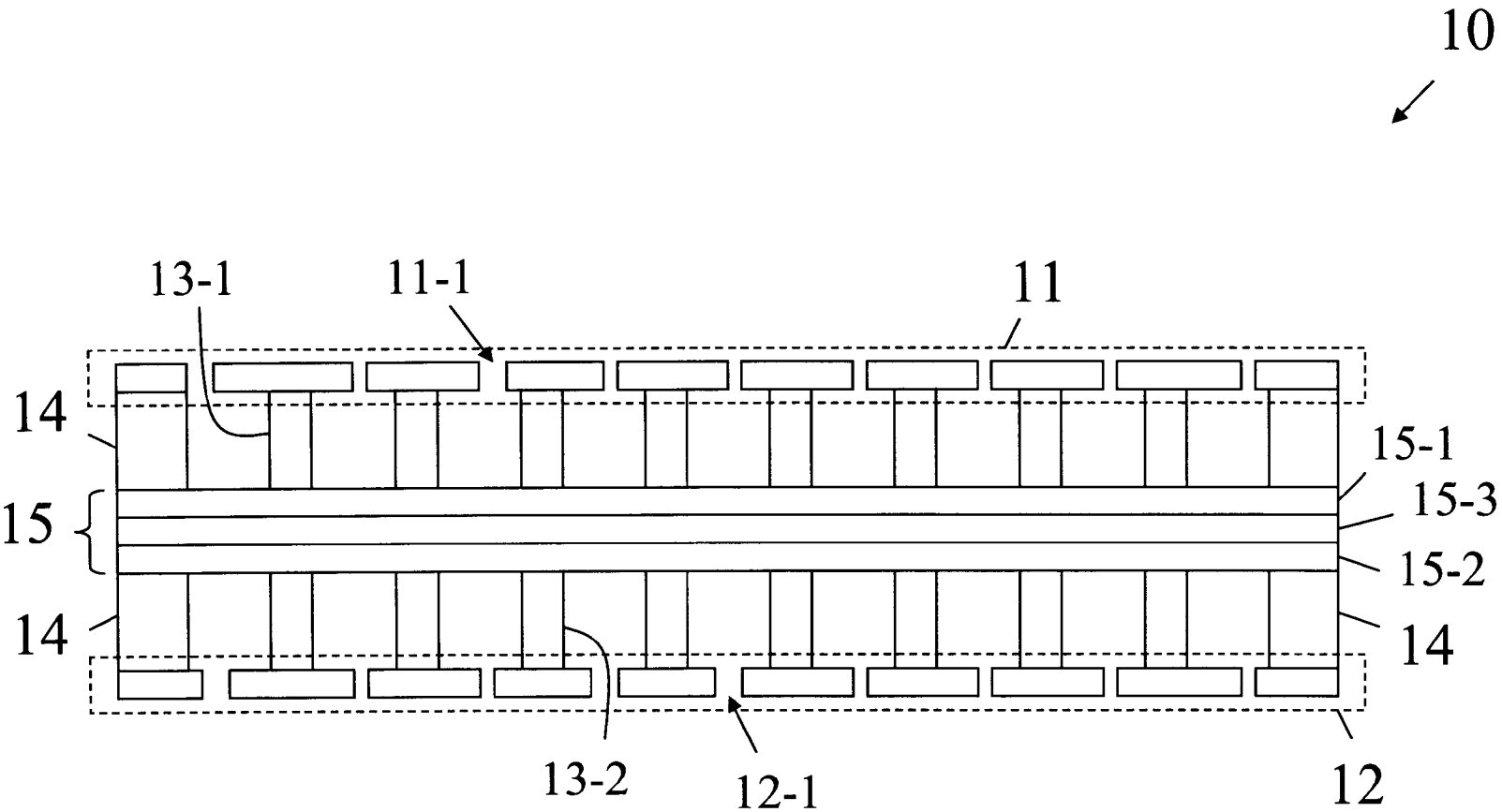
FIG. 1A is a schematic diagram of an electrostatic electroacoustic device in accordance with an example of the present invention.

FIG. 1A is a schematic diagram of an electrostatic electroacoustic device 10 in accordance with an example of the present invention. The electrostatic electroacoustic device 10 may include but is not limited to an electroacoustic transducer capable of converting between an acoustic signal and an audio signal. Referring to FIG. 1A, the electrostatic electroacoustic device 10 may include a first electrode 11, a second electrode 12, an electret assembly 15 between the first electrode 11 and the second electrode 12, a first spacer 13-1 between the first electrode 11 and the electret assembly 15, and a second spacer 13-2 between the second electrode 12 and the electret assembly 15.

The first electrode 11 and the second electrode 12 may be capable of vibratory motion in response to an audio signal. Each of the first electrode 11 and the second electrode 12 may include one of a conductive metal plate and a polymer plate on which an electrically conductive layer is provided. In various examples according to the present invention, each of the first electrode 11 and the second electrode 12 may be optically transparent and may include a material selected from one or more of polyimide (PI), polycarbonate (PC), polyethylene terephthalate (PET), polymethyl methacrylate (PMMA), cyclic olefin copolymer (COC) and a suitable photoelectric material. In other examples, each of the first electrode 11 and the second electrode 12 may be flexible and may include one of a conductive metal film or net, a conductive fiber and a polymeric substrate on which a conductive film is provided. The conductive fiber, which may take the form of a sheet, net or felt, may include but is not limited to one or more of a metal fiber, a carbon fiber, a graphite fiber or a non-conductive fiber such as a glass fiber coated with metal, carbon or graphite. The polymeric substrate may include one of PI, PC, PET, PMMA and COC, while the conductive film coated on the polymeric substrate may include one of indium tin oxide (ITO) and indium zinc oxide (IZO).

Each of the first electrode 11 and the second electrode 12 may have a thickness ranging from approximately 10 to 3000 micrometers (μm). The first electrode 11 may include a number of holes 11-1 to serve as acoustic passages. Likewise, the second electrode 12 may include a number of holes 12-1 to serve as acoustic passages. In various examples, the ratio of the holes 11-1 to the first electrode 11 in area may range from approximately 5% to 70%. Methods for forming the holes 11-1 and 12-1 may include but are not limited to a patterning and etching process, a laser radiation process or a suitable mechanical process.

The electret assembly 15 may include a first electret 15-1, a second electret 15-2 and a conductive film 15-3 between the first electret 15-1 and the second electret 15-2. An electret may refer to a dielectric that is able to produce a permanent external electric field which results from permanent ordering of molecular dipoles or from stable uncompensated surface or space charge. In various examples according to the present invention, each of the first electret 15-1 and the second electret 15-2 may include one or more dielectric film selected from one or more of polyterafluoroethylene (PTFE), fluorinated ethylene propylene (FEP), amorphous fluoropolymer (AF), COC and a transparent polymer containing fluorine (F). The dielectric film may be meso-porous or nano-porous, and may be "electrized" by, for example, corona charging, to permanently maintain electrostatic charges. Specifically, the first electret 15-1 and the second electret 15-2 may be positively charged with electric holes or negatively charged with electrons. The conductive film 15-3, which may be sandwiched between the first electret 15-1 and the second electret 15-2, may include but is not limited to a metal film, such as an aluminum film, and an ITO or IZO film. Methods for forming the conductive film 15-3 may include one of evaporation, sputtering and spin coating. In operation, the electret assembly 15 may move relative to the first electrode 11 and the second electrode 12 when a signal from the signal source is applied to the electrodes 11 and 12. The electret assembly 15 in various examples may have a thickness ranging from approximately 1 to 1000 μm, and the conductive film 15-3 may have a thickness ranging from approximately 0.01 to 3 μm.

The first spacer 13-1 and the second spacer 13-2 may provide a predetermined distance to allow the electret assembly 15 to move between the first electrode 11 and the second electrode 12. In one example, each of the first spacer 13-1 and the second spacer 13-2 may have a thickness of approximately 2 to 1000 μm. Suitable materials for the spacers 13-1 and 13-2 may include but are not limited to PI, PC, PET, PMMA or COC. The electrostatic electroacoustic device 10 may further include supporting rings 14 on the peripheries of the device 10. The supporting rings 14 may be flush with the spacers 13-1 and 13-2. In various examples, the supporting rings 14 may include substantially the same material as the spacers 13-1 and 13-2. Based on selection of materials, the electrostatic electroacoustic device 10 may exhibit features of transparency, flexibility or both. These features may facilitate the electroacoustic device's outlook design and its configuration or assembly with other electronic products.

Figure 1B:
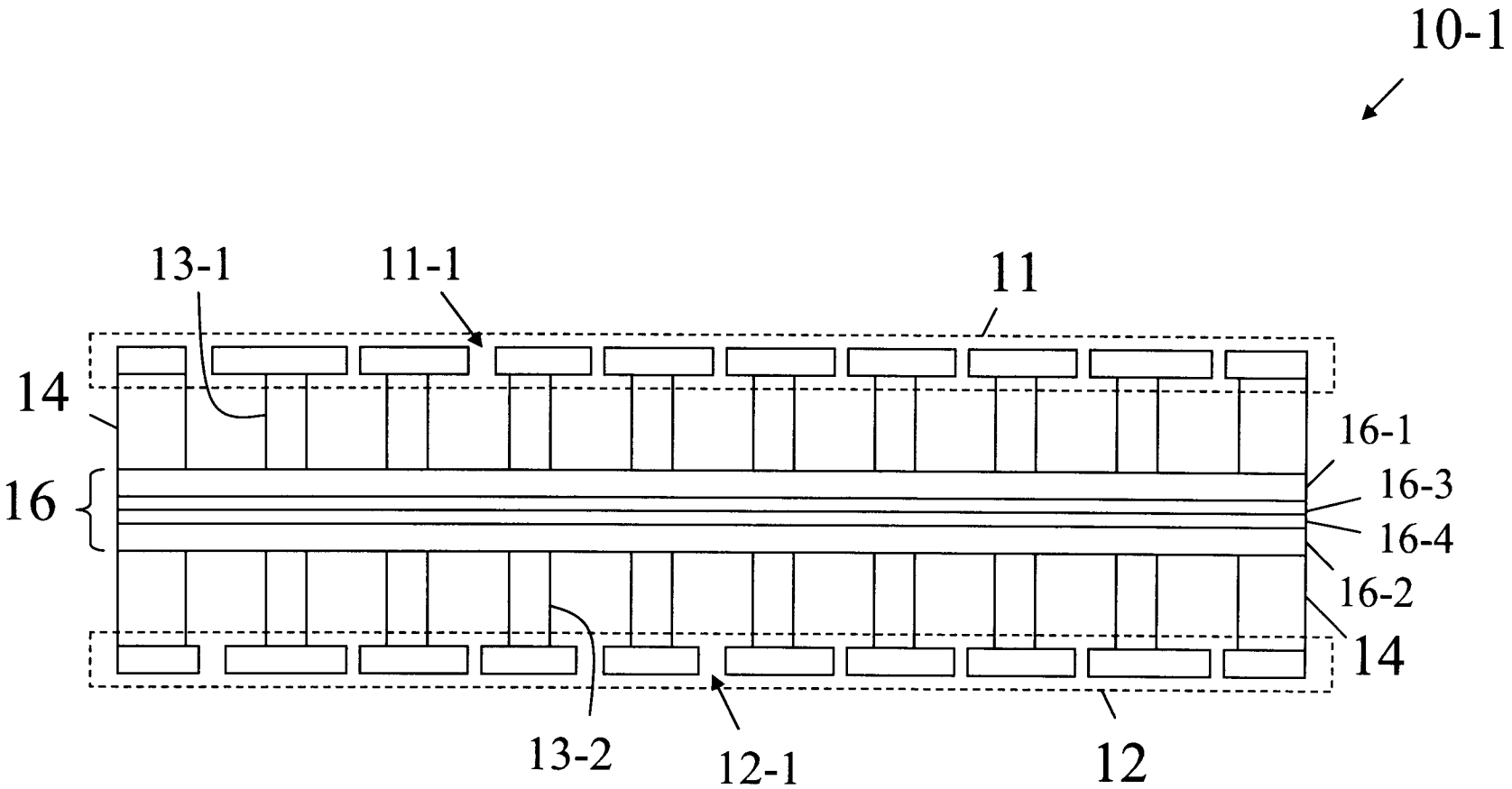
FIG. 1B is a schematic diagram of an electrostatic electroacoustic device in accordance with another example of the present invention.

FIG. 1B is a schematic diagram of an electrostatic electroacoustic device 10-1 in accordance with another example of the present invention. Referring to FIG. 1B, the electrostatic electroacoustic device 10-1 may be similar to the electrostatic electroacoustic device 10 described and illustrated with reference to FIG. 1A except that an electret assembly 16 replaces the electret assembly 15. The electret assembly 16 may include a first electret 16-1, a second electret 16-2, a first conductive film 16-3 between the first electret 16-1 and the second electret 16-2, and a second conductive film 16-4 between the first conductive film 16-3 and the second electret 16-2. As compared to the single-film structure (including conductive film 15-3), the double-film structure (films 16-3 and 16-4) may facilitate the manufacturing of the electrostatic electroacoustic device 10-1.

Figure 1C:
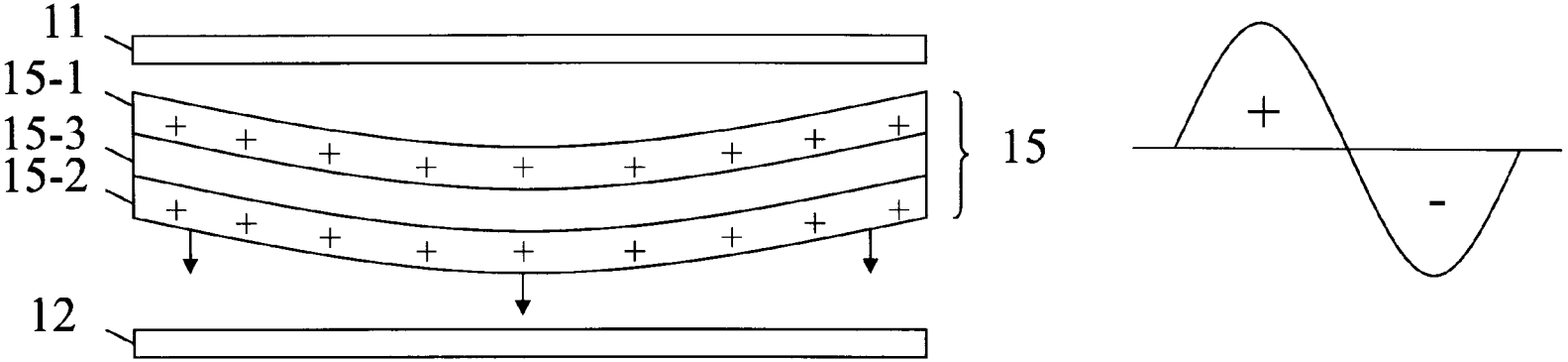
FIGS. 1C and 1D are schematic diagrams illustrating the operation of the electrostatic electroacoustic device illustrated in FIG. 1A.
Figure 1D:
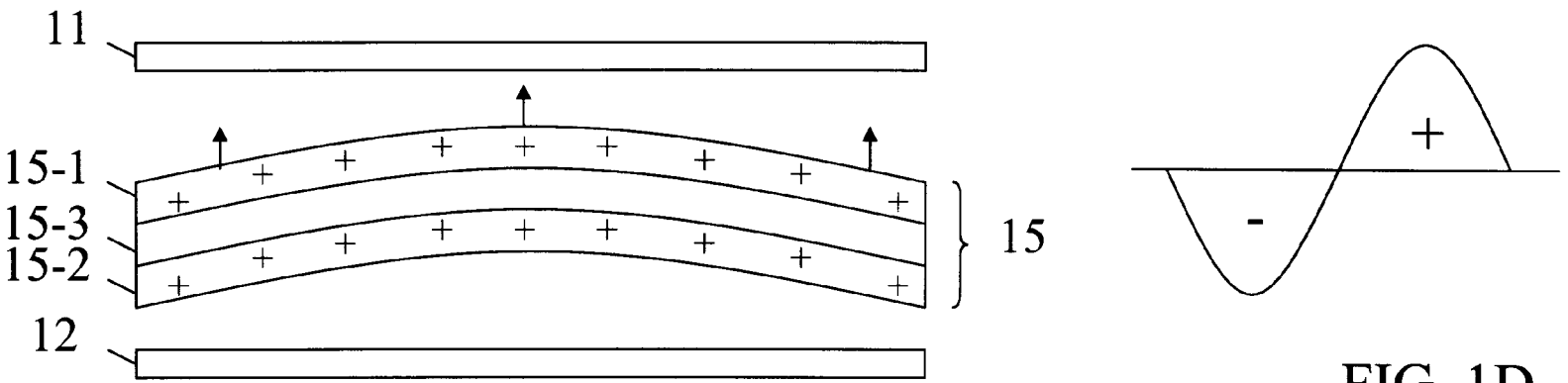

FIGS. 1C and 1D are schematic diagrams illustrating the operation of the electrostatic electroacoustic device 10 described and illustrated with reference to FIG. 1A. Referring to FIGS. 1A and 1C, the first electrode 11 and the second electrode 12 may be coupled to a signal source (not shown) and receive an audio signal therefrom. The audio signal may include, for example, sound waves in the form of an alternating-current (AC) signal. Referring to FIG. 1C, during a first half cycle of the audio signal, the first electrode 11 may be positively biased, which may repulse the first electret 15-1, the conductive film 15-3 and the second electret 15-2 toward the second electrode 12. Meanwhile, the second electrode 12 may be negatively biased, which may attract the second electret 15-2, the conductive film 15-3 and the first electret 15-1 toward the second electrode 12. As a result, the electret assembly 15 may move relative to the first electrode 11 toward the second electrode 12.

Referring to FIG. 1D, during a second half cycle, the first electrode 11 may be negatively biased, which may attract the first electret 15-1, the conductive film 15-3 and the second electret 15-2 toward the first electrode 11. Meanwhile, the second electrode 12 may be positively biased, which may repulse the second electret 15-2, the conductive film 15-3 and the first electret 15-1 toward the first electrode 11. As a result, the electret assembly 15 may move relative to the second electrode 12 toward the first electrode 11. In the example described and illustrated with reference to FIGS. 1C and 1D, it is assumed that the first electret 15-1 and the second electret 15-2 are positively charged. In various examples, however, the first electret 15-1 and the second electret 15-2 may be negatively charged. In other examples, the first electret 15-1 and the second electret 15-2 may be charged with different electrical polarity.

Figure 2A:
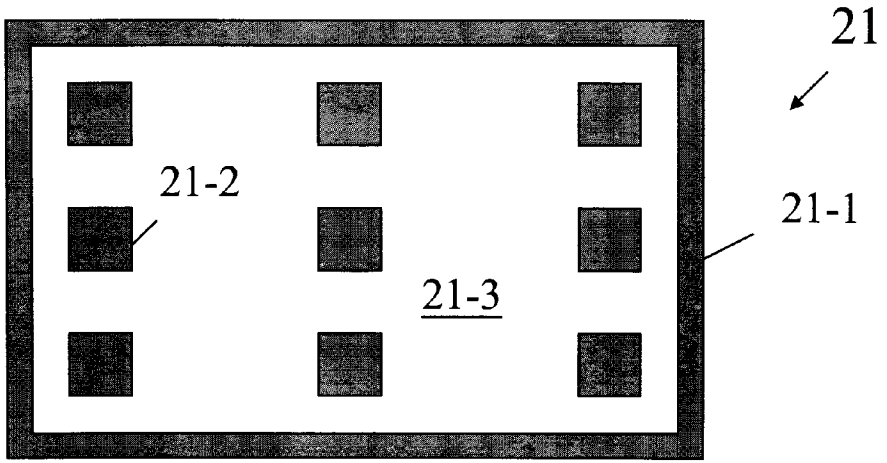
FIG. 2A is a top planar view of a spacer of an electrostatic electroacoustic device in accordance with an example of the present invention.

FIG. 2A is a top planar view of a spacer 21 of an electrostatic electroacoustic device in accordance with an example of the present invention. Referring to FIG. 2A, the spacer 21 may include a pattern formed by, for example, a patterning and etching process. Specifically, the spacer 21 may include a frame unit 21-1 and support units 21-2, which are configured to support an electrode such as the first electrode 11 illustrated in FIG. 1A. Space 21-3 defined between the frame unit 21-1 and the support units 21-2 may serve as acoustic passages. For simplicity, the passages are illustrated in simple geometric shapes. In other examples, however, the passages may have various shapes, sizes, geometries, etc.

Figure 2B:
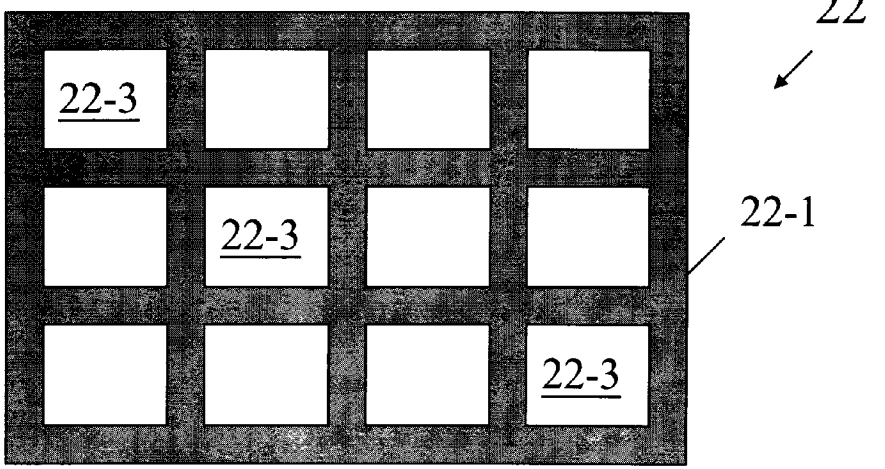
FIG. 2B is a top planar view of a spacer of an electrostatic electroacoustic device in accordance with another example of the present invention.

FIG. 2B is a top planar view of a spacer 22 of an electrostatic electroacoustic device in accordance with another example of the present invention. Referring to FIG. 2B, the spacer 22 may include a frame unit 22-1 having a grid pattern configured to support an electrode. Space 22-3 defined in the grid pattern may serve as acoustic passages.

Figure 3A:
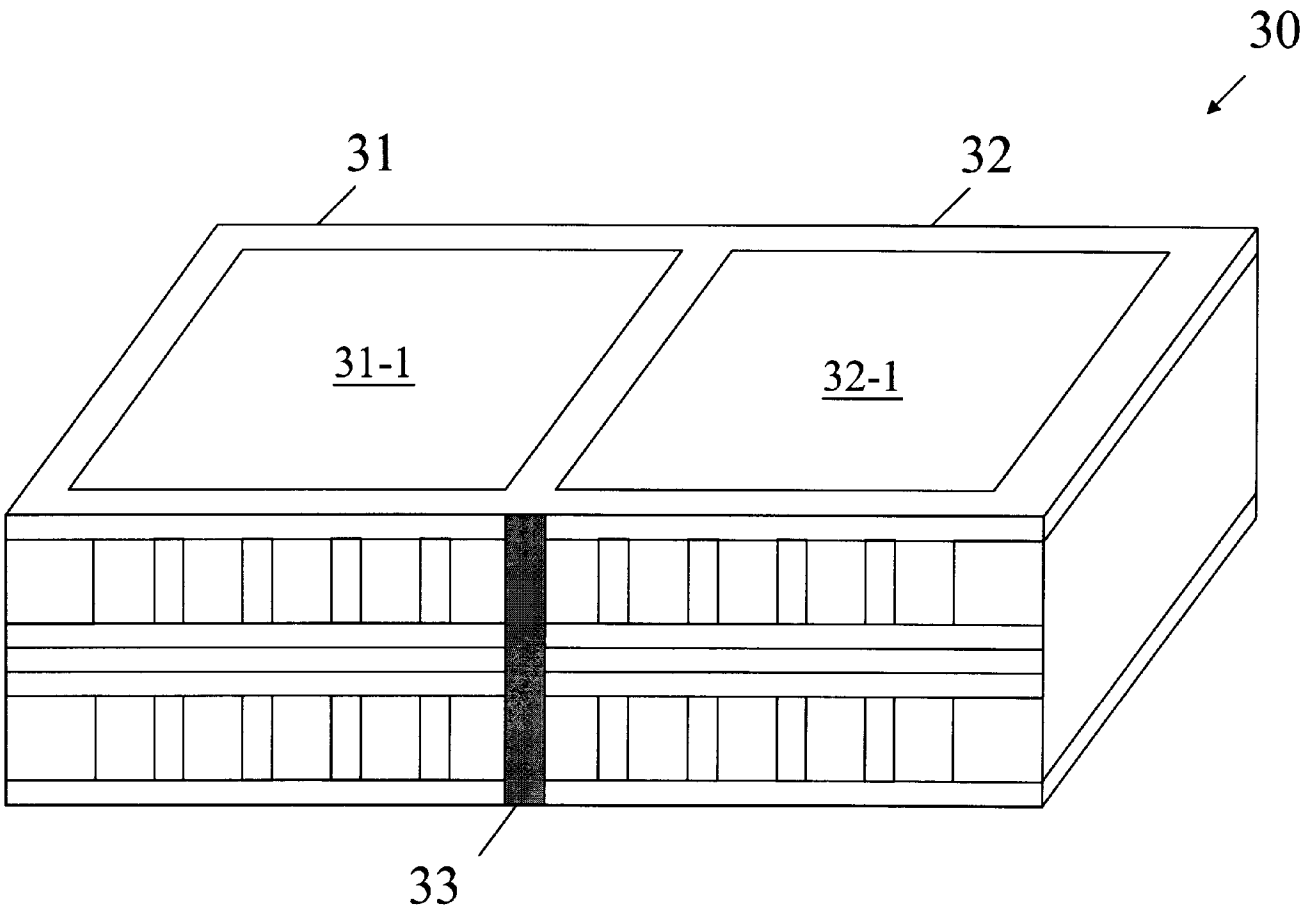
FIG. 3A is a schematic, front perspective view of an electrostatic electroacoustic device in accordance with still another example of the present invention.

FIG. 3A is a schematic, front perspective view of an electrostatic electroacoustic device 30 in accordance with still another example of the present invention. Referring to FIG. 3A, the electrostatic electroacoustic device 30 may include a first acoustic unit 31 and a second acoustic unit 32. Each of the first acoustic unit 31 and the second acoustic unit 32 may be similar in structure to the electrostatic electroacoustic device 10 described and illustrated with reference to FIG. 1A or the electrostatic electroacoustic device 10-1 described and illustrated with reference to FIG. 1B. The first acoustic unit 31 and the second acoustic unit 32 may be juxtaposed and electrically isolated from one another by an insulating layer 33. An electrode 31-1 of the first acoustic unit 31 and an electrode 32-1 of the second acoustic unit 32 may be coupled with a signal source via a frequency divider in one example. The first acoustic unit 31 may serve as a first sound channel for a first part such as a low frequency part of the sound spectrum, while the second acoustic unit 32 may serve as a second sound channel for a second part such as a high frequency part of the sound channel. Skilled persons in the art will understand that an electrostatic electroacoustic device according to the present invention may be configured to provide multi-channel capabilities, which may facilitate emulation of stereo performance.

Figure 3B:
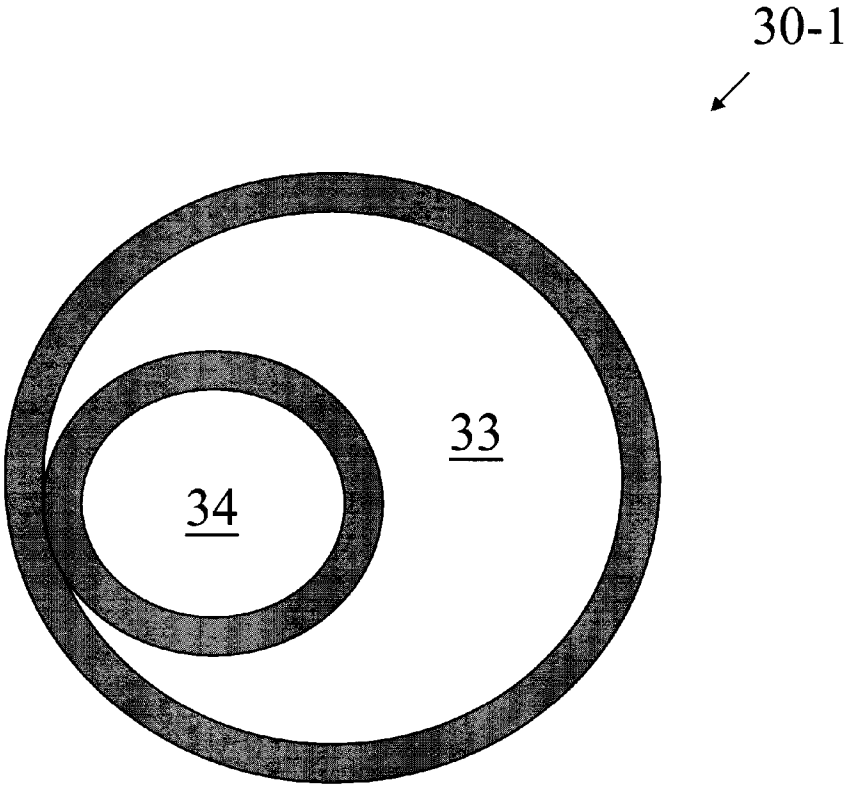
FIG. 3B is a top planar view of an electrostatic electroacoustic device in accordance with yet another example of the present invention.
Figure 3E:
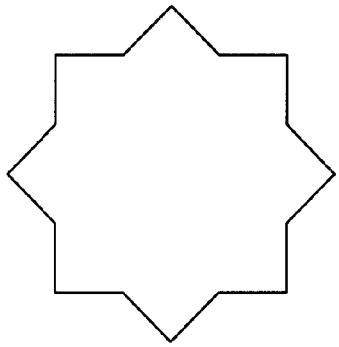
FIGS. 3C to 3F are top planar views of acoustic units of the electrostatic electroacoustic device illustrated in FIG. 3A.
Figure 3F:
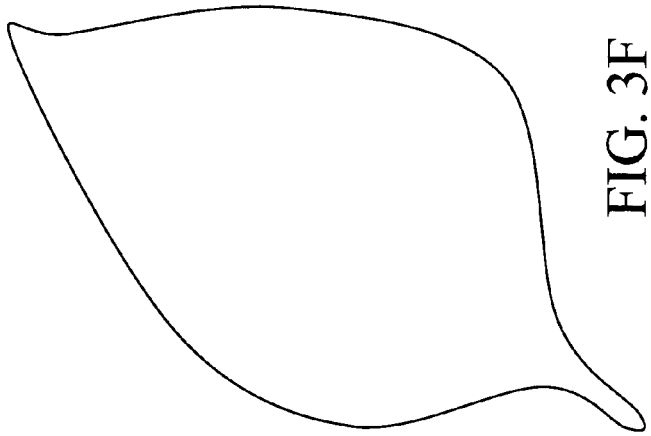
Figure 3D:
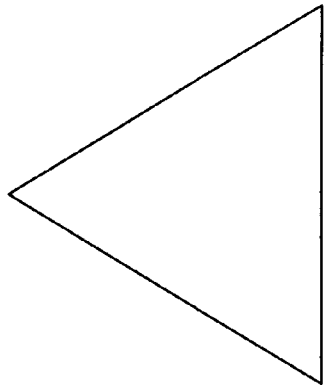
Figure 3C:
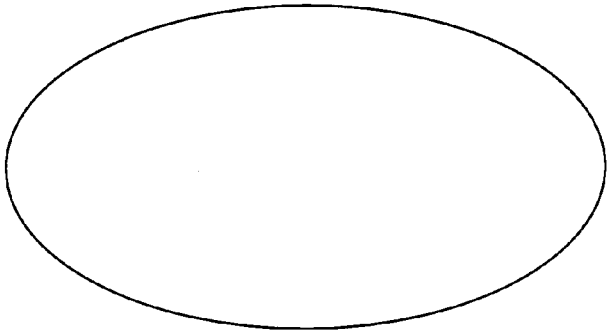

FIG. 3B is a top planar view of an electrostatic electroacoustic device 30-1 in accordance with yet another example of the present invention. Referring to FIG. 3B, the electrostatic electroacoustic device 30-1 may be similar to the electrostatic electroacoustic device 30 described and illustrated with reference to FIG. 3A except that a first acoustic unit 33 and a second acoustic unit 34 may have a circular shape instead of a rectangular shape. Furthermore, the first acoustic unit 33 may have a greater size than the second acoustic unit 34. Moreover, the second acoustic unit 34 may be disposed within the first acoustic unit 33. Since the first and second acoustic units 33 and 34 may be made of flexible materials, skilled persons in the art will understand that each of the first and second acoustic units 33 and 34 may take the form of a circular, elliptical, triangle, rectangular, polygonal, irregular or arbitrary shape, as can be seen in FIGS. 3C to 3F.

Figure 4:
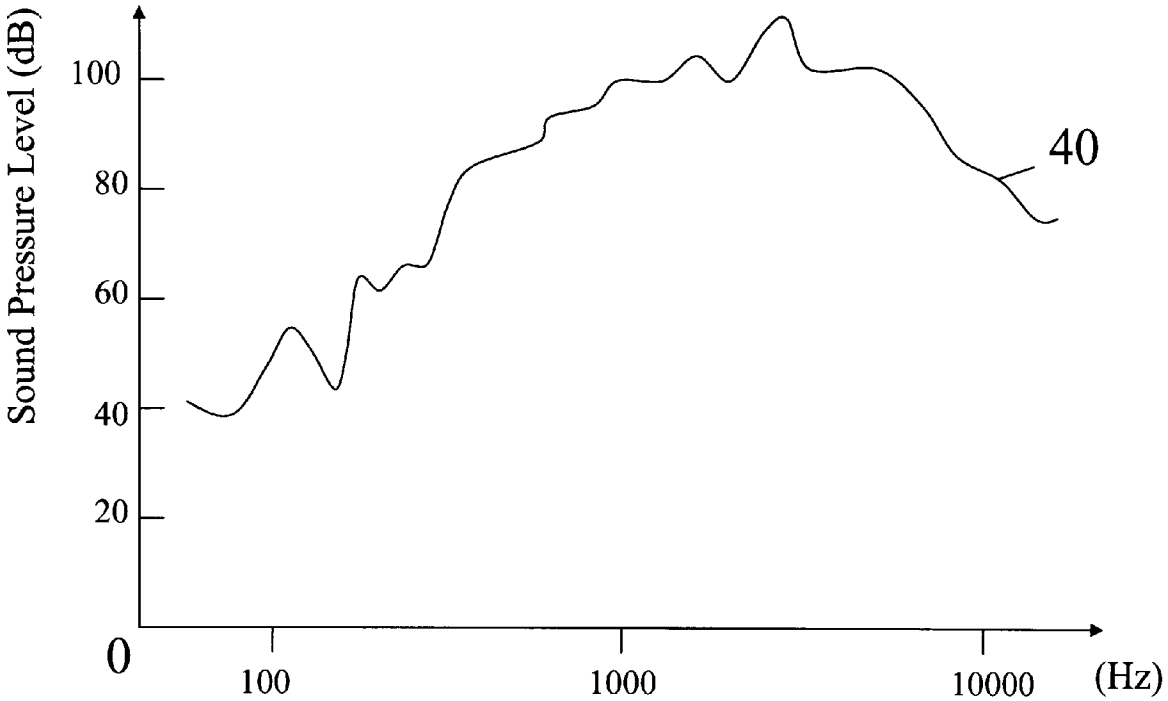
FIG. 4 is a diagram illustrating the characteristics of frequency response of an electrostatic electroacoustic device in accordance with an example of the present invention.

FIG. 4 is a diagram illustrating the characteristics of frequency response of an electrostatic electroacoustic device in accordance with an example of the present invention. Referring to FIG. 4, the frequency response of the electrostatic electroacoustic device may be represented by a curve 40. As compared to a characteristic curve of a conventional dynamic transducer, the curve 40 may be relatively flat and smooth because no peaks or resonant points may occur.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment.

It will be appreciated by those skilled in the art that changes could be made to the examples described above without departing from the broad inventive concept thereof. It is understood, therefore, that this invention is not limited to the particular examples disclosed, but it is intended to cover modifications within the spirit and scope of the present invention as defined by the appended claims.

We claim:

1. An electrostatic electroacoustic device comprising:

a first electrode, comprising a plurality of first electrode sections which are physically separated from each other, configured to receive an audio signal;

a second electrode, comprising a plurality of second electrode sections which are physically separated from each other, configured to receive the audio signal;

a first electret between the first electrode and the second electrode, the first electret including at least one dielectric layer containing electrostatic charges;

a second electret between the first electrode and the second electrode, the second electret including at least one dielectric layer containing electrostatic charges, wherein the first and second electrets are charged with different electrical polarity;

a plurality of first spacers, wherein each of the first spacers is connected with, and between, a respective one of the first electrode sections and the first electret;

a plurality of second spacers, wherein each of the second spacers is connected with, and between, a respective one of the second electrode sections and the second electret; and a conductive layer sandwiched between the first electret and the second electret, the conductive layer, the first electret and the second electret being capable of vibratory motion relative to the first electrode and the second electrode based on the audio signal.

2. The device of claim 1, wherein each of the first electrode and the second electrode includes a material selected from at least one of polyimide (PI), polycarbonate (PC), polyethylene terephthalate (PET), polymethyl methacrylate (PMMA) and cyclic olefin copolymer (COC).

3. The device of claim 1, wherein each of the first electrode and the second electrode includes one of a conductive metal film, a conductive fiber and a polymeric substrate on which a conductive film is provided.

4. The device of claim 3, wherein the conductive fiber includes at least one of a metal fiber, a carbon fiber, a graphite fiber, or a glass fiber coated with metal, carbon or graphite.

5. The device of claim 3, wherein the polymeric substrate includes one of PI, PC, PET, PMMA and COC.

6. The device of claim 5, wherein the conductive film coated on the polymeric substrate includes one of indium tin oxide (ITO) and indium zinc oxide (IZO).

7. The device of claim 1, wherein each of the first electret and the second electret includes at least one dielectric layer, the at least one dielectric layer including a material selected from at least one of polyterafluoroethylene (PTFE), fluorinated ethylene propylene (FEP), amorphous fluoropolymer (AF), COC and a transparent polymer containing fluorine (F).

8. The device of claim 1, wherein the conductive layer includes one of an aluminum film, ITO film and IZO film.

9. The device of claim 1, wherein the conductive layer includes a first conductive film attached to the first electret and a second conductive film attached to the second electret.

10. The device of claim 1 further comprising a first spacer between the first electrode and the first electret, and a second spacer between the second electrode and the second electret.

11. The device of claim 10, wherein each of the first spacer and the second spacer includes one of PI, PC, PET, PMMA and COC.

12. An electrostatic electroacoustic device comprising:

a first electrode, comprising a plurality of first electrode sections which are physically separated from each other;

a second electrode, comprising a plurality of second electrode sections which are physically separated from each other;

an electret assembly between the first electrode and the second electrode, the electret assembly including a first electret, a second electret and a conductive layer sandwiched between the first electret and the second electret, wherein the first and second electrets are charged with different electrical polarity;

a plurality of first spacers, wherein each of the first spacers is connected with, and between, the electret assembly and a respective one of the first electrode sections; and a plurality of second spacers, wherein each of the second spacers is connected with, and between, the electret assembly and a respective one of the second electrode sections, wherein the electret assembly being capable of vibratory motion relative to the first electrode and the second electrode based on an audio signal applied to the first electrode and the second electrode.

13. The device of claim 12, wherein each of the first electrode and the second electrode includes a material selected from at least one of polyimide (PI), polycarbonate (PC), polyethylene terephthalate (PET), polymethyl methacrylate (PMMA) and cyclic olefin copolymer (COC).

14. The device of claim 12, wherein each of the first electrode and the second electrode includes one of a conductive metal film, a conductive fiber and a polymeric substrate on which a conductive film is provided.

15. The device of claim 14, wherein the conductive fiber includes at least one of a metal fiber, a carbon fiber, a graphite fiber, or a glass fiber coated with metal, carbon or graphite.

16. The device of claim 14, wherein the polymeric substrate includes one of PI, PC, PET, PMMA and COC, and the conductive film coated on the polymeric substrate includes one of indium tin oxide (ITO) and indium zinc oxide (IZO).

17. The device of claim 12, wherein each of the first electret and the second electret includes at least one dielectric layer, the at least one dielectric layer including a material selected from at least one of polyterafluoroethylene (PTFE), fluorinated ethylene propylene (FEP), amorphous fluoropolymer (AF), COC and a transparent polymer containing fluorine (F).

18. The device of claim 12, wherein the conductive layer includes one of an aluminum film, ITO film and IZO film.

19. The device of claim 12, wherein the conductive layer includes a first conductive film attached to the first electret and a second conductive film attached to the second electret.

20. The device of claim 12, wherein each of the first spacer and the second spacer includes one of PI, PC, PET, PMMA and COC.

21. The device of claim 12, wherein each of the first spacer and the second spacer includes a pattern.

22. An electrostatic electroacoustic device comprising:

a first acoustic unit configured to serve as a first sound channel for a first frequency part of an audio signal; and a second acoustic unit configured to serve as a second sound channel for a second frequency part of the audio signal, wherein each of the first acoustic unit and the second acoustic unit comprises:

a first electrode, comprising a plurality of first electrode sections which are physically separated from each other;

a second electrode, comprising a plurality of second electrode sections which are physically separated from each other;

a first electret between the first electrode and the second electrode, the first electret including at least one dielectric layer containing electrostatic charges;

a second electret between the first electrode and the second electrode, the second electret including at least one dielectric layer containing electrostatic charges, wherein the first and second electrets are charged with different electrical polarity;

a plurality of first spacers, wherein each of the first spacers is connected with, and between, a respective one of the first electrode sections and the first electret;

a plurality of second spacers, wherein each of the second spacers is connected with, and between, a respective one of the second electrode sections and the second electret; and a conductive layer sandwiched between the first electret and the second electret, the conductive layer, the first electret and the second electret being capable of vibratory motion relative to the first electrode and the second electrode based on the audio signal.

23. The device of claim 22, wherein each of the first electrode and the second electrode includes a material selected from at least one of polyimide (PI), polycarbonate (PC), polyethylene terephthalate (PET), polymethyl methacrylate (PMMA) and cyclic olefin copolymer (COC).

24. The device of claim 22, wherein each of the first electrode and the second electrode includes one of a conductive metal film, a conductive fiber and a polymeric substrate on which a conductive film is provided.

25. The device of claim 24, wherein the conductive fiber includes at least one of a metal fiber, a carbon fiber, a graphite fiber, or a glass fiber coated with metal, carbon or graphite.

26. The device of claim 24, wherein the polymeric substrate includes one of PI, PC, PET, PMMA and COC, and the conductive film coated on the polymeric substrate includes one of indium tin oxide (ITO) and indium zinc oxide (IZO).

27. The device of claim 22, wherein each of the first electret and the second electret includes at least one dielectric layer, the at least one dielectric layer including a material selected from at least one of polyterafluoroethylene (PTFE), fluorinated ethylene propylene (FEP), amorphous fluoropolymer (AF), COC and a transparent polymer containing fluorine (F).

28. The device of claim 22, wherein the conductive layer includes one of an aluminum film, ITO film and IZO film.

29. The device of claim 22, wherein the conductive layer includes a first conductive film attached to the first electret and a second conductive film attached to the second electret.

30. The device of claim 22 further comprising a first spacer between the first electrode and the first electret, and a second spacer between the second electrode and the second electret.

31. The device of claim 30, wherein each of the first spacer and the second spacer includes one of PI, PC, PET, PMMA and COC.

32. The device of claim 30, wherein each of the first spacer and the second spacer includes a pattern.

33. The device of claim 22, wherein each of the first acoustic unit and the second acoustic unit includes one of a circular, elliptical, triangle, rectangular and polygonal shape.

34. The device of claim 22, wherein the first acoustic unit and the second acoustic unit are juxtaposed with one another.

35. The device of claim 22, wherein the first acoustic unit has a greater size than the second acoustic unit.

36. The device of claim 1, wherein the at least one dielectric layer of the first electret and the at least one dielectric layer of the second electret are electrized to permanently maintain electrostatic charges.

37. The device of claim 12, wherein the at least one dielectric layer of the first electret and the at least one dielectric layer of the second electret are electrized to permanently maintain electrostatic charges.

38. The device of claim 22, wherein the at least one dielectric layer of the first electret and the at least one dielectric layer of the second electret are electrized to permanently maintain electrostatic charges.

39. The device of claim 1, wherein the at least one dielectric layer of the first electret and the at least one dielectric layer of the second electret are electrized by corona charging to permanently maintain electrostatic charges.

40. The device of claim 12, wherein the at least one dielectric layer of the first electret and the at least one dielectric layer of the second electret are electrized by corona charging to permanently maintain electrostatic charges.

41. The device of claim 22, wherein the at least one dielectric layer of the first electret and the at least one dielectric layer of the second electret are electrized by corona charging to permanently maintain electrostatic charges.

42. The device of claim 1, wherein the at least one dielectric layer is meso-porous or nano-porous.

43. The device of claim 12, wherein the at least one dielectric layer is mesoporous or nano-porous.

44. The device of claim 22, wherein the at least one dielectric layer is mesoporous or nano-porous.

45. The device of claim 1, wherein the conductive layer comprises a first conductive film and a second conductive film which are overlapped with each other.

46. The device of claim 12, wherein the conductive layer comprises a first conductive film and a second conductive film which are overlapped with each other.

47. The device of claim 22, wherein the conductive layer comprises a first sub-conductive layer and a second sub-conductive layer which are overlapped with each other.

* * * * *